US005504507A

United States Patent [19]

Watrobski et al.

[11] Patent Number: 5,504,507

[45] Date of Patent: Apr. 2, 1996

[54] ELECTRONICALLY READABLE PERFORMANCE DATA ON A THERMAL INK JET PRINTHEAD CHIP

[75] Inventors: Thomas E. Watrobski, Rochester; Joseph J. Wysocki, Webster; Thomas A. Tellier; Joseph F. Stephany, both of Williamson; Michael Poleshuk; Gary A. Kneezel, both of Webster; Richard V. LaDonna, Fairport, all of N.Y.

[73] Assignee: Xerox Corporation, Stamford, Conn.

[21] Appl. No.: 425,268

[22] Filed: Apr. 17, 1995

Related U.S. Application Data

[63] Continuation of Ser. No. 967,835, Oct. 8, 1992.

[51] Int. Cl.[6] ..... B41J 2/01

[52] U.S. Cl. ..... 347/19

[58] Field of Search ..... 347/19, 14

[56] References Cited

U.S. PATENT DOCUMENTS

| | | | |
|---|---|---|---|
| 4,369,923 | 8/1983 | Noda | 346/76 PH |
| 4,774,530 | 9/1988 | Hawkins | 346/140 R |
| 4,831,395 | 5/1989 | Phom et al. | 346/160 |
| 4,872,027 | 10/1989 | Buskirk et al. | 346/140 R |
| 4,894,712 | 1/1990 | Katsukawa | 346/76 PH |
| 5,049,898 | 9/1991 | Arthur et al. | 346/1.1 |
| 5,235,351 | 8/1993 | Koizumi | 346/140 R |
| 5,363,134 | 11/1994 | Barbehenn et al. | 347/49 |

OTHER PUBLICATIONS

Mano, M. Morris; Digital Design; Prentice–Hall, 1984, p. 182.

European Patent Application 412 459 A2, Yamaguchi et al., "Ink jet recording apparatus and ink cartridge for the apparatus", Filed: Mar. 8, 1990.

German Patent Application P 4,020,885, Siemens et al., "Process for Setting the Pulse Voltage for Heating Resistors in Ink–Jet Heads", Filed: Jun. 29, 1990.

Xerox Disclosure Journal—*Storage of Operating Parameters in Memory Integral with Printhead Chip* by Robert A. Lonis—vol. 8, No. 6, Nov./Dec. 1983.

*Primary Examiner*—Benjamin R. Fuller
*Assistant Examiner*—Craig A. Hallacher
*Attorney, Agent, or Firm*—R. Hutter

[57] ABSTRACT

Data relating to the performance of an individual ink-jet printhead is stored in an electrically-readable form on a silicon substrate forming an essential part of the printhead. A template of electrically-detectable structure is created on the substrate at manufacture, and then portions of the structure are removed in accordance with the data desired to be stored. In one embodiment, the digital performance data may be encoded and also read out in serial form using a shift register on the chip.

3 Claims, 4 Drawing Sheets

ELECTRONICALLY READABLE PERFORMANCE DATA ON A THERMAL INK JET PRINTHEAD CHIP

This is a continuation of application Ser. No. 07/957,835, filed Oct. 8, 1992.

BACKGROUND OF THE INVENTION

1. Field of the Invention

The present invention relates to a control system for a thermal ink jet printer. Specifically, the present invention relates to an electronically-readable medium relating to the performance of a particular ink-jet printhead, provided directly on a silicon chip forming the printhead.

In thermal ink jet printing, droplets of ink are selectively emitted from a plurality of drop ejectors in a printhead, in accordance with digital instructions, to create a desired image on a surface. The printhead typically comprises a linear array of ejectors for conveying the ink to the sheet. The printhead may move back and forth relative to a surface, for example to print characters, or the linear array may extend across the entire width of a sheet (e.g. a sheet of plain paper) moving relative to the printhead. The ejectors typically comprise capillary channels, or other ink passageways, forming nozzles which are connected to one or more common ink supply manifolds. Ink from the manifold is retained within each channel until, in response to an appropriate digital signal, the ink in the channel is rapidly heated and vaporized by a heating element disposed within the channel. This rapid vaporization of the ink creates a bubble which causes a quantity of ink to be ejected through the nozzle to the sheet. An exemplary patent showing the general configuration of a typical ink jet printhead is U.S. Pat. No. 4,774,530 to Hawkins.

In most designs of ink jet printing apparatus currently commercially available or contemplated, an essential portion of the printhead, particularly the portion of the printhead having the heating element formed thereon, is in the form of a silicon substrate. This silicon substrate is generally known as the "chip" of the printhead, and typically includes not only the heating elements formed thereon, but the series of electrical leads connecting each of the heating elements to a voltage source. The leads are typically in the form of a pattern of aluminum depositions, and a typical construction of the heating element is in the form of a deposit of polycrystalline silicon which forms an element having a predetermined resistance.

In a common method of manufacture of thermal ink-jet printhead modules or "chips," each chip is sized to accommodate 128 nozzles spaced at a density of 300 nozzles per inch; in terms of a chip, 128 heating elements are provided, each heating element having at least one lead connected thereto, as well as any other electronic circuitry which may be formed on the chip. In mass production of such chips, as many as 200 or more chips may be formed in a single silicon "wafer," the entire wafer being manufactured in one step and then subsequently cut, or "diced," into the chips themselves.

An important practical concern for commercially-acceptable printheads is a consistency of performance characteristics among a plurality of chips. An important factor affecting the quality of an image formed on a sheet is uniformity of "spot size." All of the ejectors in a printhead must create spots on the sheet of uniform size given certain operating conditions, particularly power to the heating elements and temperature of the liquid ink. Equally important is spot size uniformity among various printhead chips. In many commercially available or contemplated thermal ink jet printing apparatus, it is intended that the chips will have an expected life shorter than that of the machine in general, and therefore will require periodic replacement. Other known designs include a plurality of separate, abutting chips being used simultaneously. Various manufacturing conditions may cause variations among chips which may be very small in absolute terms, but which will have a significant effect on spot size uniformity. Minute variations in, for example, the dimensions of the channels forming the nozzles, or in the resistivity of the polysilicon forming the heating elements, may have a substantial effect on the spot size associated with a particular chip. For customer satisfaction, it is necessary that spot size remain uniform not only under various external conditions for one chip, but also from chip to chip as chips are replaced during the course of the life of the machine. Such chip-to-chip uniformity is particularly crucial in an apparatus in which multiple chips are employed simultaneously, as in a full-width array apparatus in which as many as 20 chips may be abutted to form an array which extends across a sheet. It is therefore desirable that a thermal ink-jet printing apparatus include provision for recognizing variations in the performance characteristics of individual chips, and further to be able to compensate for these variations.

2. Description of the Prior Art

European Patent Application A2-0 412 459 discloses one arrangement by which information for controlling the driving conditions of a printhead is stored on a medium which forms part of the ink cartridge, in an apparatus wherein an individual printhead is associated with an expendable ink cartridge. The medium may contain information such as the color of the ink in the ink cartridge. In various described embodiments, this medium may be in the form of a predetermined resistance located on the cartridge, a magnetic stripe, an optically readable bar code, or some three-dimensional information pattern disposed on the housing of the ink cartridge.

German Patent Application P-4,020,885 discloses an ink-jet printhead wherein the chip associated therewith includes an additional reference resistor, created at the same time as the heating resistors, and which therefore should share many of the relevant electrical characteristics with the actual heating resistors. The provision of the reference resistor enables the printing apparatus to pre-test the chip so that an optimum pulse voltage may be set for the heating resistors, in correspondence with the measured resistance value.

SUMMARY OF THE INVENTION

According to the present invention, there is provided a chip for a thermal ink-jet printhead. A plurality of heating elements is defined on the substrate forming the chip. Each heating element is associated with an ejector. An electronically-readable medium, defined on the substrate, is capable of storing a value having a symbolic relationship to a performance characteristic of the printhead.

According to another aspect of the present invention, there is provided a method of manufacturing a chip for a thermal ink-jet printhead, the chip having a plurality of heating elements defined thereon. Each heating element is associated with an ejector. The method comprises the step of providing, on the substrate, an electronically-readable medium capable of storing a value having a symbolic relationship to a performance characteristic of the printhead.

While the present invention will hereinafter be described in connection with preferred embodiments thereof, it will be understood that it is not intended to limit the invention to these embodiments. On the contrary, it is intended to cover all alternatives, modifications, and equivalents as may be included within the spirit and scope of the invention as defined by the appended claims.

DETAILED DESCRIPTION OF THE INVENTION

Figure 6:
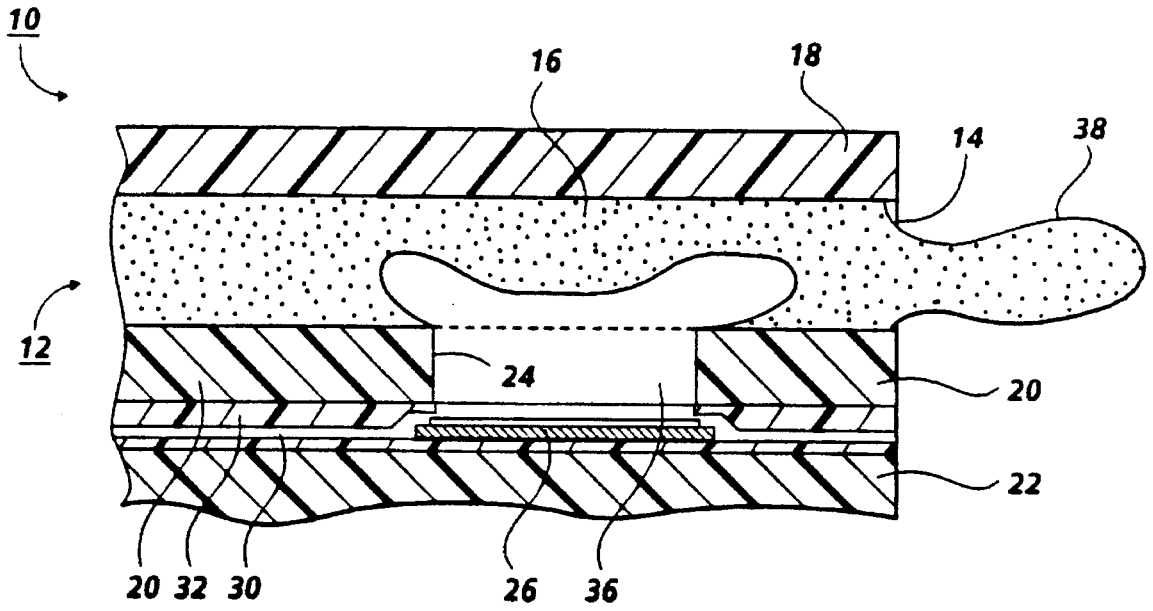
FIG. 6 PRIOR ART
FIG. 6 is a fragmentary sectional elevational view of a drop ejector of an ink jet printhead.

FIG. 6 is a fragmentary sectional elevational view of a drop ejector of an ink jet printhead, one of a large plurality of such ejectors which would be found in one version of an ink jet printhead. Typically, such ejectors are sized and arranged in linear arrays of 300 ejectors per inch. As will be used in the detailed description, a silicon member having a plurality of channels for drop ejectors defined therein, typically 128 ejectors, is known as a "die module" or "chip." In currently popular designs, a typical chip defines 128 ejectors, spaced 300 to the inch. In designs with multiple chips, each chip may include its own ink supply manifold, or multiple chips may share a single common ink supply manifold.

Each ejector, or nozzle, generally indicated as 10, includes a capillary channel 12 which terminates in an orifice 14. The channel 12 regularly holds a quantity of ink 16 which is maintained within the capillary channel 12 until such time as a droplet of ink is to be ejected. Each of a plurality of capillary channels 12 are maintained with a supply of ink from an ink supply manifold (not shown). The channel 12 is typically defined by an abutment of several layers. In the ejector shown in FIG. 6, the main portion of channel 12 is defined by a groove anisotropically etched in an upper substrate 18, which is made of a crystalline silicon. The upper substrate 18 abuts a thick-film layer 20, which in turn abuts a lower silicon substrate 22.

Sandwiched between thick film layer 20 and lower substrate 22 are electrical elements which cause the ejection of a droplet of ink from the capillary channel 12. Within a recess 24 formed by an opening in the thick film layer 20 is a heating element 26. The heating element 26 is typically protected by a protective layer 28 made of, for example, a tantalum layer having a thickness of about 0.5 microns. The heating element 26 is electrically connected to an addressing electrode 30. Each of the large number of ejectors 10 in a printhead will have its own heating element 26 and individual addressing electrode 30, to be controlled selectively by control circuitry, as will be explained in detail below. The addressing electrode 30 is typically protected by a passivation layer 32.

When an electrical signal is applied to the addressing electrode 30, energizing the heating element 26, the liquid ink immediately adjacent the element 26 is rapidly heated to the point of vaporization, creating a bubble 36 of vaporized ink. The force of the expanding bubble 36 causes a droplet 38 of ink to be emitted from the orifice 14 onto the surface of a sheet. The "sheet" is the surface on which the mark is to be made by the droplet, and may be, for example, a sheet of paper or a transparency.

In imparting energy to liquid ink in the capillary channel 12 to cause the objection thereof, the power applied to heating element 26 may be controlled by either of two variables: the voltage applied to the heating element 26, or the time duration of the voltage pulse to cause the ejection of droplet 38. The minimum voltage applied to heating element 26 to cause the ejection of droplet 38 is known as the "threshold voltage." The voltage applied to heating element 26 must be in excess of this threshold voltage; however, if the applied voltage to heating element 26 is excessively greater than the drop voltage, not only will there be a waste of energy in operating the printhead, but the excess voltage will ultimately cause the printhead to overheat, thus increasing the temperature of the liquid ink in the printhead, very likely affecting the spot size. Methods for controlling temperature, or compensating for temperature by manipulation of other parameters to maintain a uniform spot size, represent a major concern to designers of thermal ink-jet apparatus. Thus, excessive voltage will exacerbate an already-acute temperature control problem within a thermal ink-jet printhead. Further, consistent application of excessive voltage will significantly decrease the working life of the printhead, either by gradually baking ink residue onto the heating elements, or by catastrophically causing an open circuit in the heating element. Similar temperature and wear problems may result from excessive duration of the voltage pulses applied to the heating element 26.

Figure 7A:
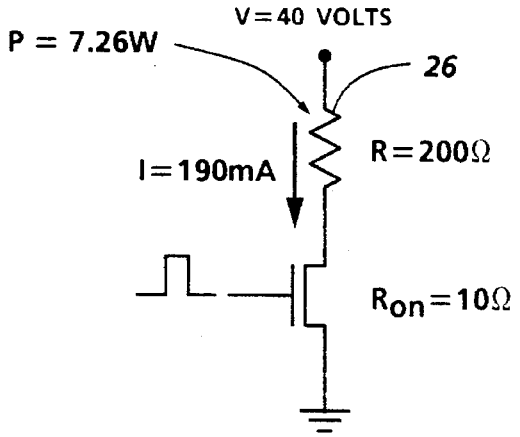
FIG. 7A PRIOR ART
FIGS. 7A and 7B are comparative circuit diagrams illustrating a variation in performance characteristics among printhead chips.
Figure 7B:
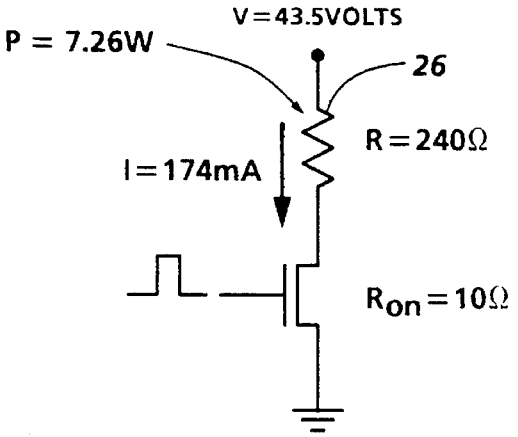
FIG. 7B PRIOR ART

A key factor in determining the drop voltage and/or the necessary pulse duration to a particular thermal ink-jet printhead is the resistance associated with the heating element 26. Since the power consumed by the heater is described by $V^2/R$, where V is the applied voltage and R is the heater resistance, for a constant applied voltage, the higher the heater resistance, the less power is consumed. FIGS. 7A and 7B are comparative circuit diagrams showing how a variation in resistances between two heating elements 26 can have a substantial effect on the drop voltage of a printhead. The heating element 26 (shown as a resistor) of 200 ohms, while the heating element 26 in FIG. 7B has a resistance of 240 ohms. Also shown in each diagram is a driver for activating the heating element 26 in the form of a transistor switch 40. The driver 40 forms a connection between a power supply toward the top of each diagram and ground. In these examples, it is assumed that a fixed 7 watts of power must be consumed by the heating element 26 over a fixed three-microsecond driver pulse. For a constant voltage power supply of 40 volts, the heating element in FIG. 7A will consume 7.26 watts of power, sufficient for drop ejection. However, applying the same supply voltage condition for the heating element in FIG. 7B, only 6.14 watts are consumed. In order to equal the power consumption of the heating element in FIG. 7A, the heating element in FIG. 7B would require an increase in power supply to 43.5 volts to cause ejection of a droplet.

If the resistances of the resistors in FIGS. 7A and 7B are representative of acceptable fabrication tolerance limits, than a power supply fixed at 43.5 volts would guarantee sufficient drop forming for the set of all chips in a product line, all other conditions being equal. With the voltage level of 43.5 volts, the heating element of FIG. 7A would be driven to 8.58 watts, which would over stress the heating element 26 and thereby reduce printhead life. Thus, a control system supplying voltage to the plurality of heating elements 26 in a typical printhead must be able to take into account the inevitable variations in performance characteristics (such as, but not limited to, the mean or minimum resistance of the plurality of heating elements 26) of the individual installed printhead.

Figure 1:
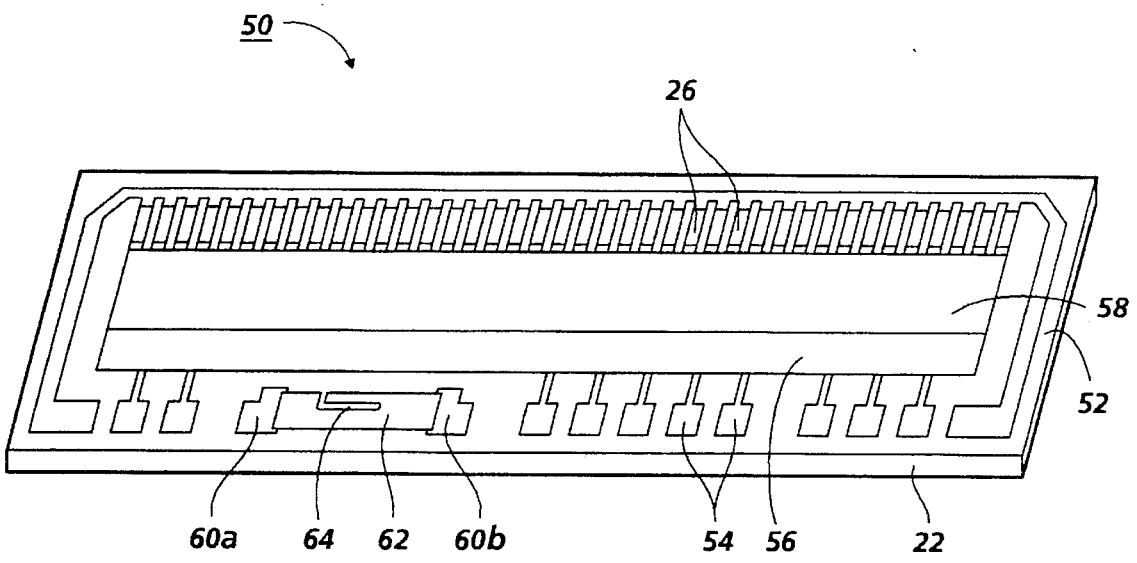
FIG. 1 is a perspective view showing a substrate associated with an ink-jet printhead in isolation, showing one embodiment of the present invention.

FIG. 1 is a perspective view showing, in isolation, a chip 50 forming the lower substrate 22 of a thermal ink-jet printhead. The lower substrate 22 is typically made of silicon, while the upper surface 52 thereof is a coating of silicon dioxide. Disposed on surface 52 is, for example, a series of terminals 54, by which the printhead is electronically controlled by a printing apparatus. Arrangements of terminals 54 for operation of the printhead are well known in the art, such as, for example, applying digital information in series or in parallel to any number of leads 54 to address a subset of the heating elements 26 on the chip 50 as needed to create a desired image. The specific circuitry for controlling heating elements 26 through terminals 54 is shown generally as logic 56, which may be of any form familiar to those skilled in the art. Logic 56, in turn, drives a set of parallel drivers generally indicated as 58, which serve to activate, that is apply the necessary voltage, to the heaters 26 as needed. Both logic 56 and drivers 58 may be formed on the surface 52 of chip 50 using any known IC fabrication techniques.

Also disposed on the chip 50 is the set of heating elements 26, which in the complete ink-jet printhead would be disposed adjacent corresponding capillary channels in an abutting upper substrate (not shown) to form the ejectors or nozzles of the ink-jet printhead. The heating elements 26 are typically made of polycrystalline silicon connected to depositions of aluminum which also forms a lead to the respective heating elements 26. The terminals 54 are made of depositions of aluminum, as is familiar in the art of IC fabrication.

In one portion of the chip 50, generally in the same area as the terminals 54, are a pair sense pads indicated as 60*a* and 60*b*. These sense pads are provided as terminals which may be accessed by the printing apparatus in the same manner as the terminals 54, in a manner known in the art. Operatively disposed between sense pads 60*a* and 60*b* is an area of resistivity 62. This area of resistivity 62 is preferably made of polycrystalline silicon, and placed on the surface 52 of chip 50 using the same mask as was used to form the heaters 26. Thus, both the heating elements 26 and the area of resistivity 62 will preferably be fabricated simultaneously.

The purpose of the area of resistivity 62 is to provide a desired resistance between sense pads 60*a* and 60*b* in such a manner that the printing apparatus may detect the amount of this resistance. The measured amount of this resistance can, in turn, be processed by the printing apparatus as a symbolic representation of certain performance data associated with the individual printhead 50. This performance data may be, but is not limited to, the mean or minimum resistance of the heating elements 26. However, it should be emphasized that, according to the present invention, the area of resistivity 62 is adapted to store symbolic data relating to the printhead as opposed to merely forming another test resistance. Because the system will read the resistance and interpret it in any possible way, the value of the resistance of area of resistivity 62 may relate to many different things besides the resistance of the heaters 26, as required by the design of the apparatus. For example, the value may be representative of information relating to the mean or maximum current measured on the chip during wafer probe testing, the necessary type of ink to be used with the printhead, or even the date the chip was manufactured.

In order to obtain a desired value of resistance in the area of resistivity 62, there is defined in the area of resistivity 62 a trim area 64, which is created as the result of removing a predetermined amount of polycrystalline silicon. Various ways of removing preselected quantities of the polycrystalline silicon are known, such as by means of a laser. The preferred method of using the area of resistivity 62 is to provide a "template" of a base area of resistance such as the main rectangle forming area of resistivity 62 in FIG. 1, applying a known voltage or current between the sense pads 60*a* and 60*b*, and removing a quantity of the resistive material of area of resistivity 62 such as shown in trim area 64, until a desired resistance value is obtained. Thus, when a chip 50 is freshly manufactured, necessary tests may be performed on each individual chip, or a representative chip in a batch, and then a desired resistance value between sense pads 60*a* and 60*b* may be created by removing resistive material from the template.

Figure 2:
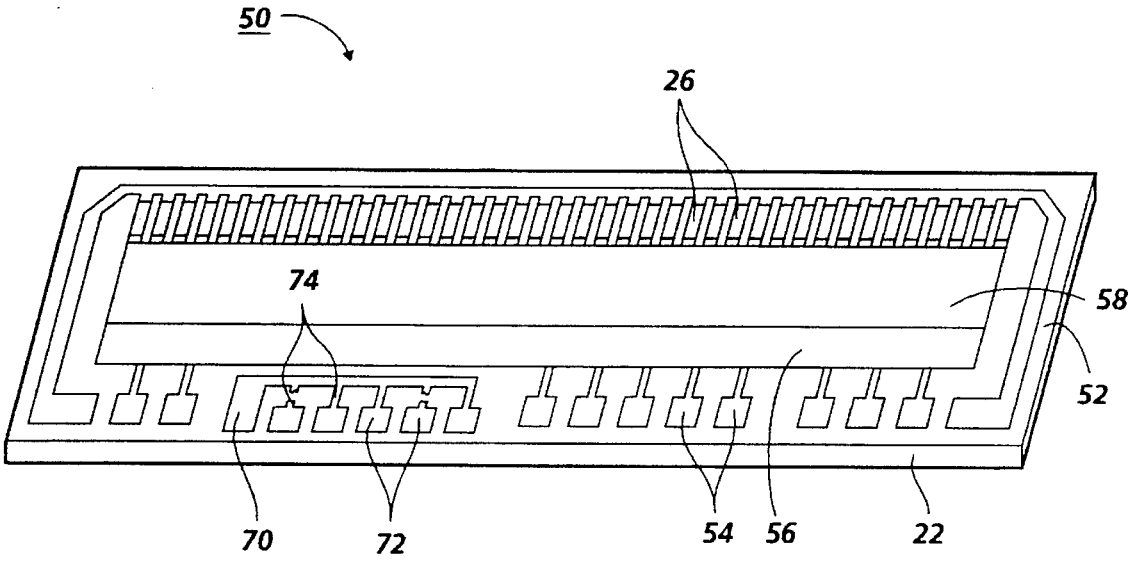
FIG. 2 is a perspective view showing a substrate associated with an ink-jet printhead in isolation, showing another embodiment of the present invention.

FIG. 2 shows an alternate embodiment of a chip 50 incorporating the features of the present invention, wherein the electronically readable data is embodied in a digital form. Here, instead of having two sense pads with an analog resistance therebetween, there is provided a stimulus pad 70, which is connected in parallel to a plurality of data output pads 72. Each data output pad 72 is preferably connected to the stimulus pad 70 by a relatively thin lead 74. The plurality of output pad 72 can then correspond to the plurality of binary digits forming a binary word having as many digits as output pads 72. The control system of the printing apparatus can, by applying a voltage to the stimulus pad 70, read out the resulting voltage on the respective output pads 72 as parallel binary data. This parallel data can then be interpreted by the control system, by techniques which would be apparent to one skilled in the art, relating to the control of the individual chip 50. The "ground rules" for interpreting the word of digital data for various purposes can be carried out in any way desired. For example, certain bits may be indicative of certain ranges of tested mean or minimum resistance for the heating elements 26; other bits may be indicative of the manufacturing date of the chip, etc., or any other conceivable parameter relating to the individual chip.

In the digital embodiment of the present invention, the chip 50 is originally manufactured with the stimulus pad 70 connected to all of the output pads 72, thus serving as the "template" which may be modified in light of such testing of the particular chip 50. In order to encode the output pads 72 with suitable digital data relating to the individual chip 50, the binary data may be created by selectively disconnecting a preselected subset of the data output pad 72 from the stimulus pad 70 so that voltage read thereon will be read as 0, as opposed to the voltage ultimately from stimulus pad 70, which will appear on the pads 72 that remain connected. In order to disconnect the desired "0" digits, one simple technique is to simply cut the respective lead 74 by means of a laser, or, alternatively, apply a relatively high voltage between a given output pad 72 and a point just opposite the corresponding lead 74, to "blow out" the relatively thin lead 74. When a voltage is applied to stimulus pad 70, the outputs of the output pad 72 will be read as a series of zeros and ones for interpretation of the control system of the printer.

A variation to the digital embodiment of the present invention shown in FIG. 2 is to create the stimulus pad 70, the output pads 72, and the intervening leads 74 out of a resistive ink which is simply printed on surface 52. In the resistive ink embodiment, the desired data to be stored on the chip may be embodied in a printed pattern in the form of stimulus pad 70 and output pad 72, with the desired ones of the leads 74 absent from the printed pattern.

It has been found that for any of the above embodiments of the present invention, a desirable range of test voltages by which the data stored on the chip is read is in the range of five volts.

Using the basic principle of the digital embodiment of the present invention, wherein certain leads 74 are effectively removed from the chip 50 to form a desired digital word, a chip 50 may further include a provision on the chip itself for reading out the digital word in a serial form. Further, provision may be made on the chip itself for encoding the desired digital word onto the chip (that is, by selectively removing a desired subset of the leads 74) with serial input data through a single line. The use of serial, as opposed to parallel, data for writing and reading this digital word creates an advantage that no additional external terminals, such as pads 72, are needed to increase the number of possible digits from which a digital word may be created, and therefore the amount of recordable data on the chip may be increased without seriously increasing the amount of realestate required for this purpose. In one embodiment of this concept, the reading and writing functions may be performed through a shift register, which is formed on the chip 50 itself, in a manner which will be familiar to those in the art.

Figure 3:
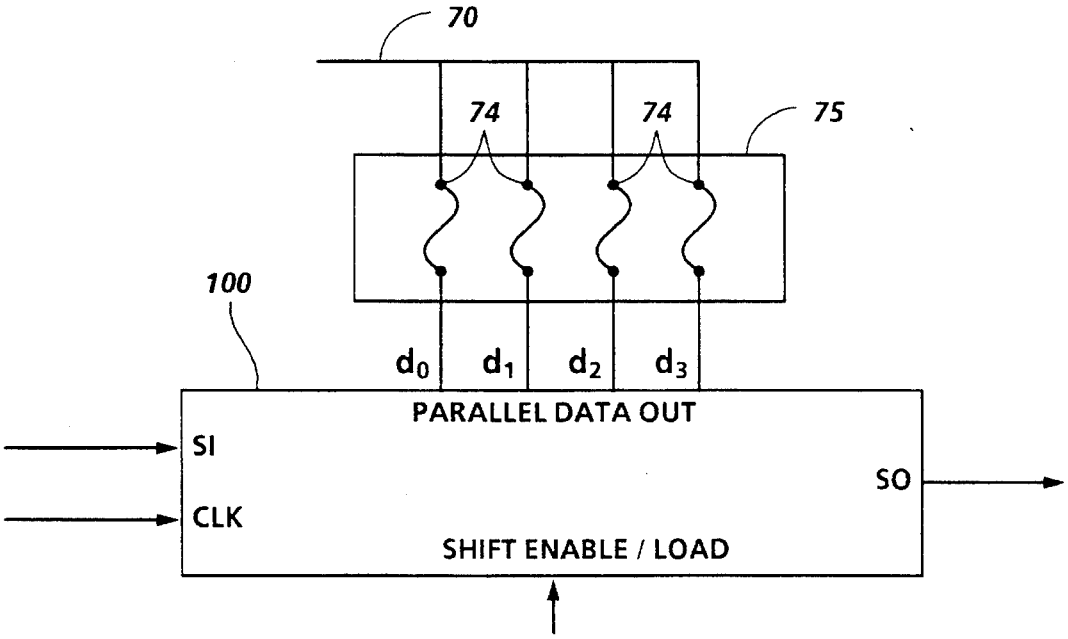
FIG. 3 is a simplified schematic diagram showing the digital embodiment of the present invention, in combination with a shift register.

FIG. 3 shows a stimulus line 70, which is analogous to the stimulus pad and bus 70 in the embodiment of FIG. 2, connected to a parallel series of leads 74 which have the same function as the leads 74 in the embodiment of FIG. 2, in this schematic diagram shown as fuses. The parallel lines of leads 74 are operatively connected in parallel fashion to a shift register 100, which is intended to be located on the chip itself, and which may be part of the logic 56 by which image data is transmitted to the heating elements 26. In fact, if the requirements of a particular chip 50 involved the use of a shift register for data output to the heating elements 26, it is conceivable that this same shift register for the data output purpose may be "borrowed" in a fabrication stage for encoding the leads 74 with a digital word. The shift register 100 includes leads for serial data in (SI), a clock function, a shift enable function, and a serial data out (SO), in addition to the parallel lines shown in FIG. 3 as $d_0$, $d_1$, $d_2$, and $d_3$, in this embodiment enabling a four-digit word. When an on-board shift register such as 100 is used in conjunction with the present invention, the various leads 74 which may be selectively removed to encode a digital word may be placed on a relatively small "fusible link bank" indicated as 75, which may be made very small, particularly small relative to the lead 74 in the embodiment of FIG. 2.

In the "write mode," the leads 74 desired to be removed for creation of the digital word are removed by application of a "write voltage" which may, for example, have a value of 30 volts in order to "blow" the desired subset of leads 74. The purpose of shift register 100 is to accept a digital word such as, in a four-bit word, "1011" at its serial in (SI) terminal and output the word in parallel form through the respective ones of the terminals $d_0$, $d_1$, $d_2$, $d_3$. By outputting a "write voltage" to the selected ones of the parallel outputs for the removal of the desired subset of the leads 74, the digital word desired for a given purpose will be encoded onto the chip.

Figure 4A:
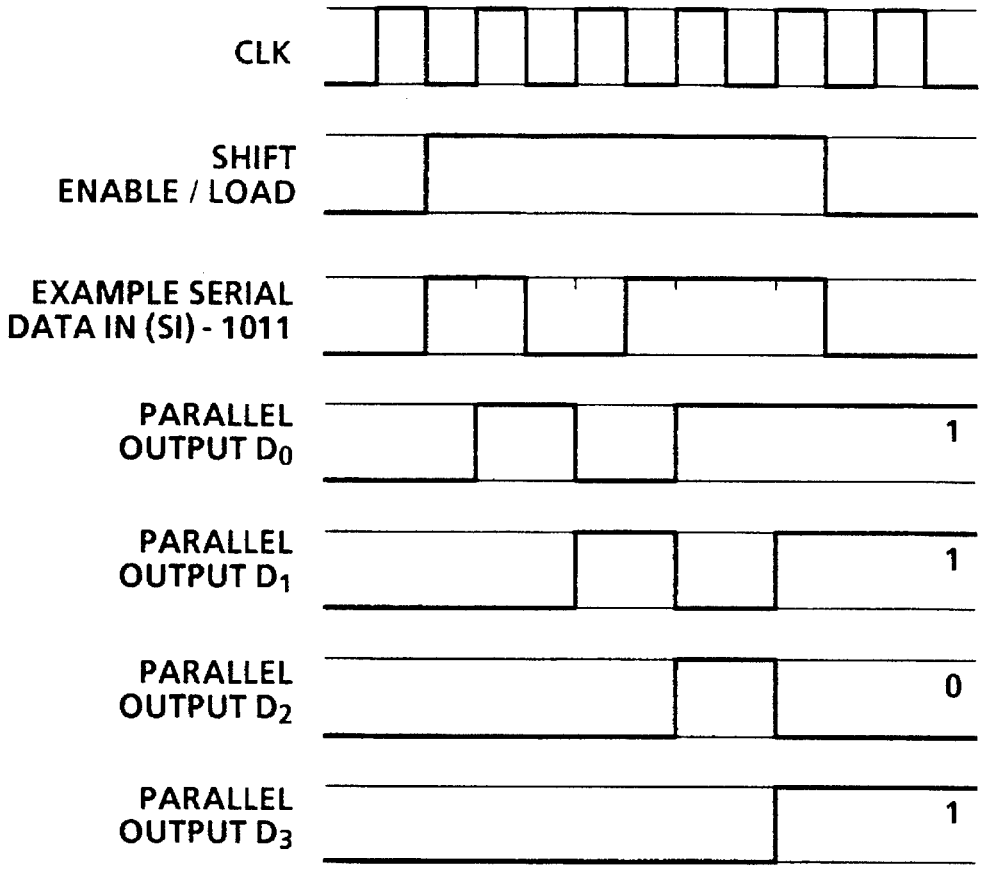
FIG. 4A is a set of comparative wave forms illustrating the "write mode" of the digital embodiment of the present invention in combination with a shift register.

FIG. 4A shows an example set of digital wave forms consistent with the input of a digital word "1101" to shift register 100. In the illustrated example, a 1 is represented by a voltage high on the serial data in (SI) line, while a 0 is a represented by a voltage low. As can be seen by a comparison of the wave forms, the serial data in is clocked against the alternating pulses of the clock CLK, to end up with parallel outputs corresponding to the serial input data. Operation of a shift register for this specific purpose will be apparent to one skilled in the art. Also, the chip 50 may be encoded under a convention in which a 1 is represented by a broken lead 74, or by a convention in which a 0 is represented by a broken lead 74; one skilled in the art will recognize that a corresponding read system will merely require consistency with the chosen convention. The stimulus line 70 may be connected to its own externally-connectible pad, as in FIG. 2, or may be connected to some other portion of circuitry on the chip. In the "write" mode, stimulus lead 70 is preferably energized to a potential consistent with a "write voltage" which will "blow" a given lead 74 if, on the other side thereof, the lead 74 is connected to an active data out from the shift register 100.

Figure 5:
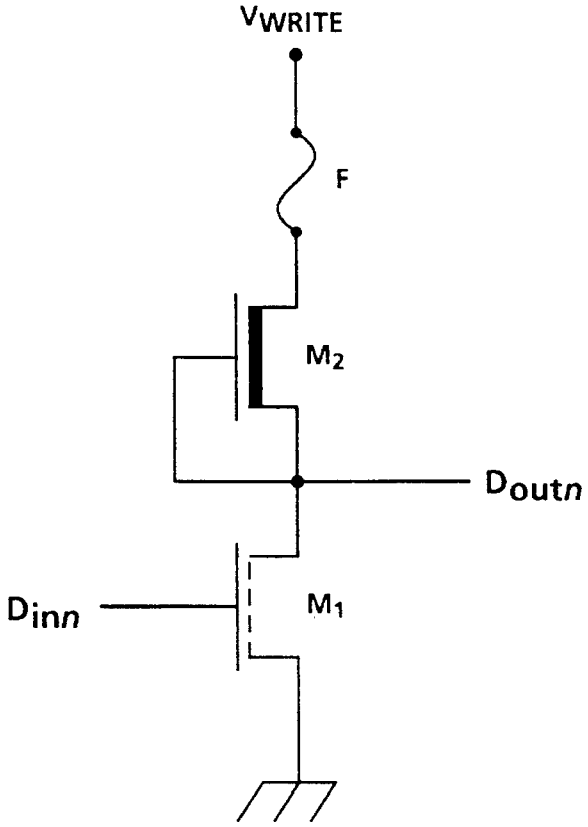
FIG. 5 is a schematic diagram of circuitry within a shift register associated with one lead in the digital embodiment of the present invention.

FIG. 5 is a schematic diagram of the circuitry within the shift register 100 for a given one of the leads 74. Connected to the lead 74 within shift register 100 are, in this embodiment, two MOS transistors $M_1$ and $M_2$, which are in turn connected in series to ground. Connected, as shown, to the MOS transistors, are two terminals $d_{inn}$ and $d_{outn}$. A logic level from the serial-to-parallel shift-in sequence is present on $d_{inn}$, which is the gate of MOS transistor $M_1$. In the case of a logical 1 present on that gate, the channel of transistor $M_1$ creates a current path from the stimulus line 70 to ground, through the lead 74. As the "write voltage" applied at stimulus line 70 is of sufficient magnitude to destroy the lead 74, completion of the circuit between stimulus line 70 and ground will cause the lead 74 to "blow." Conversely, with a logical 0 present on the gate of transistor $M_1$, the channel does not conduct, an open circuit exists between the stimulus line 70 and ground, and the lead 74 will remain intact.

Figure 4B:
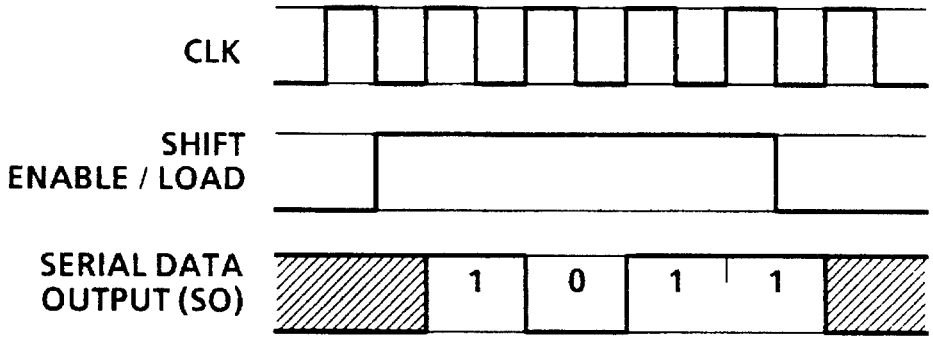
FIG. 4B is a set of comparative wave forms illustrating the "read mode" of the digital embodiment of the present invention in combination with a shift register.

FIG. 4B shows a set of wave forms for reading out the digital word encoded by the leads 74. In the "read mode," in which the word is read, a substantially lower voltage is applied to stimulus line 70, for example 5 volts, which is enough for the control circuitry of the chip 50 to detect whether a particular lead 74 is in place, but not enough to disturb the integrity of a lead 74 (as opposed to the higher "write voltage," which is intended to destroy the lead 74). The read mode involves detecting the read voltage from stimulus bus 70 through a set of leads 74 in parallel, and then detecting the read voltage on selected ones of the parallel lines $d_0$, $d_1$, $d_2$, $d_3$ to determine which of the leads 74 are absent, which is the same as reading the digital word. The parallel data entering shift register 100 is read out in serial form from terminal SO of shift register 100. FIG. 4B shows how the serial data output may coordinated with the input clock signal in a typical configuration of a shift register known in the art. Variations of this technique will be apparent to one skilled in the art, depending on a specific design of shift register.

Returning to FIG. 5, it can be seen that MOS transistor $M_2$ is operatively connected by both its gate and output to the terminal $d_{outn}$ within the shift register 100. The purpose of transistor $M_2$ is to permit the conduction of a "read voltage" on stimulus line 70 through lead 74 when a particular lead 74 is present (if the particular lead 74 has been removed in the writing mode, of course, there will be no connection). When a 5-volt read voltage passes through the lead 74, a connection is formed through transistor $M_2$, which may be read out on terminal $d_{outn}$ and ultimately read out in serial form through terminal SO of the shift register 100.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A method of operating a thermal ink-jet printhead including a silicon substrate having a plurality of heating elements defined thereon, comprising the steps of:

providing at predetermined positions on the substrate a plurality of selectably removable leads;

performing a predetermined test on at least one heating element on the substrate, thereby yielding a binary number symbolically relating to a performance characteristic of the printhead;

applying a write voltage to certain of the selectably removable leads, thereby removing said certain leads consistent with the binary number;

applying electrical energy to the predetermined positions on the substrate to yield an electrical response from each position dependent on whether the lead therein has been removed, thereby reading the binary number; and applying power to the heating element in a manner consistent with the performance characteristic symbolized by the binary number.

2. The method of claim 1, further comprising the step of providing on the substrate a main terminal and a plurality of bit terminals, with the removable leads connecting a subset of the bit terminals in parallel with the main terminal.

3. The method of claim 1, further comprising the steps of:

providing a shift register on the substrate, the shift register being operative associated with the removable leads;

entering the binary number in serial form into the shift register; and operating the shift register to application of the write voltage to a selected subset of leads to destroy the selected subset of leads in accordance with the binary number.

* * * * *